United States Patent [19]

Evert

[11] Patent Number: 4,793,490

[45] Date of Patent: Dec. 27, 1988

[54] PACKAGE FOR COMPRESSIBLE BAGS AND PROCESS

[75] Inventor: Daniel D. Evert, Bourbonnais, Ill.

[73] Assignee: Gaines Pet Foods Corp., Chicago, Ill.

[21] Appl. No.: 674,490

[22] Filed: Nov. 26, 1984

Related U.S. Application Data

[63] Continuation of Ser. No. 130,311, Mar. 14, 1980, abandoned.

[51] Int. Cl.[4] ..... B65D 85/62

[52] U.S. Cl. ..... 206/497; 206/499; 206/586

[58] Field of Search ..... 206/497, 499, 586

[56] References Cited

U.S. PATENT DOCUMENTS

| | | | |
|---|---|---|---|
| 1,937,468 | 11/1933 | Talbot | 206/497 |
| 3,315,435 | 4/1967 | Gunyou | 206/499 X |
| 3,541,752 | 11/1970 | Ness | 206/499 X |
| 3,918,584 | 11/1975 | Richardson | 206/497 |
| 4,201,138 | 5/1980 | Cox | 206/586 |

*Primary Examiner*—Steven M. Pollard

*Attorney, Agent, or Firm*—St. Onge Steward Johnston & Reens

[57] ABSTRACT

The object of the invention is to provide improved packaging for shipping and storing bags containing compressible material.

Both a method and a package are disclosed. FIG. 3 shows an array of bags 12 compressed to the height of corrugated fiberboard sleeve 14. The sleeve 14 with the bags 12 therein is covered with a tightly-stretched film 18. All surfaces, except for end 26 and the end opposite to it, are covered with the film.

The package enables shipment and storage of bags containing compressible material in unitized loads as shown in FIG. 5 with adequate protection using a minimum of packaging material, while solving the problems of leaning and uneven compression which would otherwise occur.

16 Claims, 1 Drawing Sheet

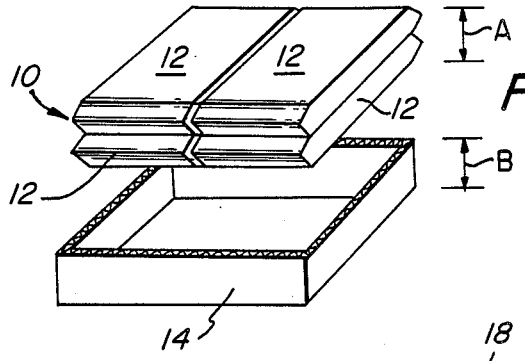
FIG. 1
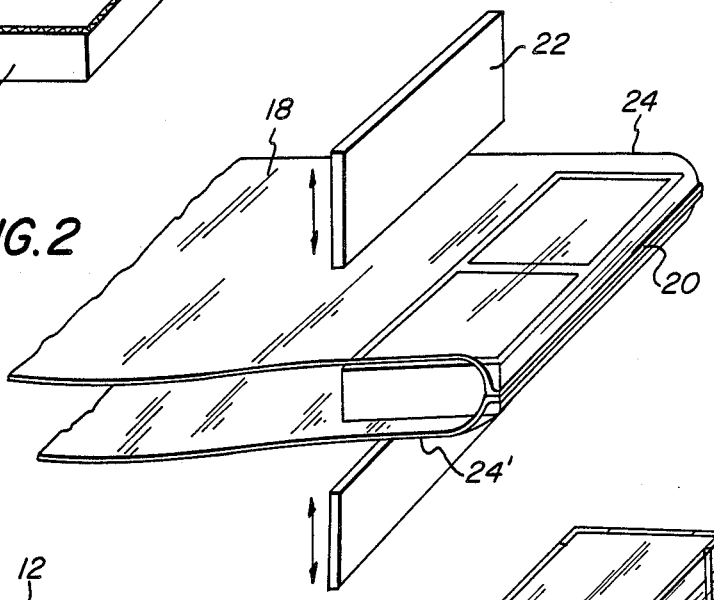
FIG. 2
FIG. 3
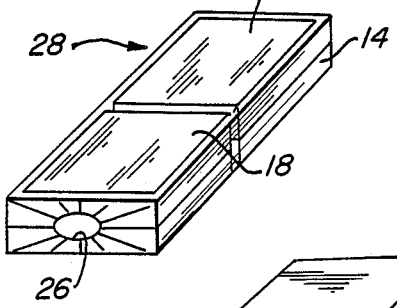
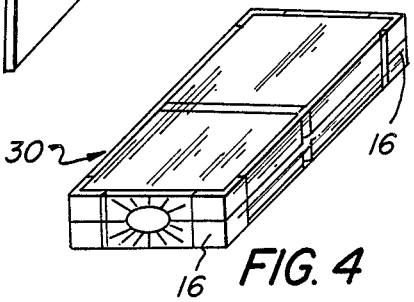
FIG. 4
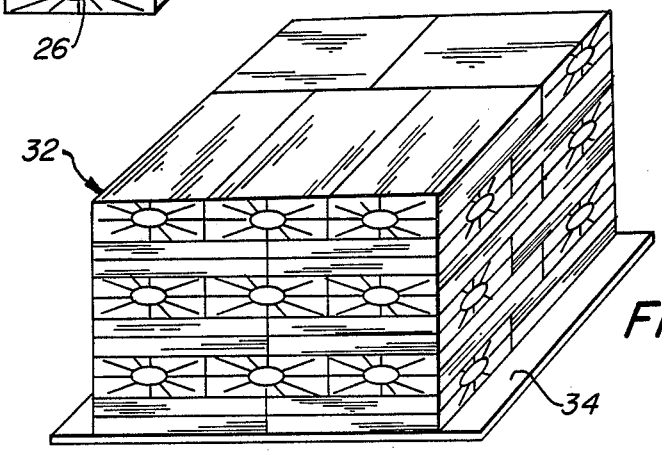
FIG. 5

PACKAGE FOR COMPRESSIBLE BAGS AND PROCESS

This application is a continuation of prior copending application Ser. No. 130,371 filed Mar. 14, 1980, now abandoned.

DESCRIPTION

1. Technical Field

This invention relates to packaging, and particularly to an improved package for shipping and storing bags containing compressible material and method for packaging them.

Shipping and storing compressible, bagged products presents a number of difficulties. Among these is the inability of the products to be stacked more than several feet high without tilting, and in some cases, falling over. Products typically compress unevenly under the weight of stacked product and leaning aggravates this problem. Also, the products at the bottom of a stack would be compressed to a greater extent than those at the top; resulting in non-uniform appearance.

In the past it has been necessary to place the bags inside fiberboard cases which supply the necessary strength to resist deformation. Unfortunately, the cost of the cases is high.

2. Background Art

The prior art has provided a number of packaging arrangements which avoid the high cost of exterior fiberboard cases for packaging rigid or non-compressible products. Among these are the arrangements shown in U.S. Pat. No. 3,853,218 to Grasvoll which shows packaging a load of heavy articles, such as cement bags, in shrink film without need for a pallet to stack the bags on. Therein, it is disclosed that a load of several superposed layers of goods can be directly lifted by a fork lift truck where the bottom layer is narrower than upper layers and is wrapped separately from them. In U.S. Pat. No. 3,918,584 to Richardson, a shipping case is described for fragile productfilled, rigid cartons. The cartons are packed within a corrugated sleeve and overwrapped with a heat shrunk plastic film to keep them from being crushed and avoiding damage to the product. Neither of the approaches, however, are directed to the problems associated with compressible products, where the compression is actually desired because it saves space and packaging material.

3. Disclosure of Invention

The present invention provides a package for, and a method for, packaging bags containing compressible material. The package is suitable for shipping and storage, and comprises: an essentially rectangular array of bags, the array having a top, a bottom and four sides forming four vertical corners, wherein, the bags each contain compressible material and the array is compressed as a unit; rigid vertical support means substantially equal in height to the height of the compressed array, positioned at least at the four vertical corners of the array; and a film of a synthetic polymeric material tightly stretched over the top, the bottom, at least two complete sides and the four vertical corners. The method, in its broad aspects, comprises the steps of: preparing an essentially rectangular array of bags as described above; positioning vertical support means, having a height less than the height of the array, at least at the vertical corners of the array; vertically compressing the array as a unit to a height less than the height of the vertical support means; permitting the array to resiliently expand to a height substantially equal to the height of the vertical support means; and applying a tightly-stretched film of synthetic polymeric material over the top, the bottom, at least two complete sides and four vertical corners.

The present invention overcomes the problems of uneven stacking and compression of bags containing compressible products without the need for expensive corrugated fiberboard cases. Additionally, the invention achieves savings in space and packaging materials by virtue of the controlled precompression of the bags.

BRIEF DESCRIPTION OF DRAWINGS

The present invention will be better understood and its advantages will become more apparent from the following detailed description, especially when read in light of the attached drawings wherein:

FIG. 1 is a perspective view showing an array of bags and corrugated fiberboard sleeve which functions as a vertical support means for positioning about the array;

FIG. 2 is a perspective view showing the application of a polymeric film about a compressed array of bags supported by a corrugated fiberboard sleeve;

FIG. 3 is a perspective view of a preferred embodiment of a package according to the present invention;

FIG. 4 is a perspective view of an alternative embodiment of a package according to the present invention; and FIG. 5 is a perspective view showing a unitized load of a number of packages, as shown in FIG. 3, stacked on a solid fiber slip sheet.

BEST MODE FOR CARRYING OUT THE INVENTION

Referring to FIG. 1, there is shown an array 10 of bags 12. Each of the bags 12 contain a compressible, resilient material such as a pet food of the type described in U.S. patent application Ser. No. 791,099, filed Apr. 26, 1977, now U.S. Pat. No. 4,190,679.

By virtue of their contents, each of the bags is compressible. The array 10 of bags 12 has a height A, measured from the top of the array to its bottom in the uncompressed state. Height A is greater than height B of the corrugated fiberboard sleeve 14. The sleeve 14 is designed to vertically support the array along the four sides and the four vertical corners where the sides meet.

The bags 12, when compressed, will provide support for the weight of stacked packages bearing their weight on the central portion of the array 10. Because the bags 12 in the array 10 are precompressed, to the desired degree, the weight of bags stacked on top of the stack will not cause further compression. The sleeve 14 of each package will provide some edge contact and some point contact with other sleeves to thereby support an additional portion of the weight of a vertically stacked load. Advantageously, because the most significant amount of the weight is supported by the product itself, the sleeve 14 need not be strong enough to support the entire load. This is in sharp contrast to certain of the prior art packages such as those shown in U.S. Pat. No. 3,918,584, where the individual units within the package are crushable.

The ability of the precompressed bags to support a significant amount of weight permits, in some circumstances, the use of angleboards 16, positioned at the four vertical corners, as shown in FIG. 4. The angleboards 16 are preferably made of laminated fiberboard of one, two or three ply construction. Angleboards of this type have the advantage that they are lower in cost than continues sleeves, such as 14. However, they have the disadvantage that they are not as easily held in position during application of an outer film 18, as shown in FIG. 2. Also, they do not provide the same high degree of dimensional stability as the continuous sleeve 14 because they are not rigidly secured, one to the other. To add dimensional stability, the length of each angleboard, 16, may be increased so as to more nearly approximate a continuous sleeve. Another reason why the sleeve 14 is preferred is because printing can be applied to it in the same manner as with a conventional case.

The array 10 of bags 12 is compressed as a unit either before or after positioning the vertical support means, such as sleeve 14 or angleboards 16 at least at the corners of the array 10. Preferably, where a sleeve 14 is employed, the array 10 will be compressed after the sleeve 14 is positioned. Where angleboards 16 are employed as the vertical support means, the array is preferably compressed before they are put into place.

The degree of compression will depend upon a number of factors including: the resiliency of the material within the individual bags 12; the compressibility without fracture, undue clumping or other adverse effect on the material within the bags; the weight of the material; and the intended stacking height. In all cases the array will be compressed from an initial height A, which is greater than B (the height of the vertical support), to a height less than B before being permitted to resiliently expand to a height substantially equal to B. Where bags 12 weigh from 5 to 20 pounds each, and contain a material with a bulky density of from 20 to 35 pounds per cubic foot; an applied force of from 2.5 to 25 lbs. per square inch, a compressibility of from 1.0 to 3.0 inches, and a resilience of from 4 to 9% will generally be satisfactory. The compression can be applied by placing the array 10 between a pair of opposed platens, both or one of which can be moved. The compressive force will preferably be in the range of from 10.0 to 15.0 pounds per square inch and will be applied over an interval of from 5 to 15 seconds. For a loosely packed material within the bag, it is important that the compressive force be applied over an interval of time sufficient to permit the material to spread out in the bag. Thus, it is the resilience of the material as bagged which is important, and this resilience is a measure not only of the resilience of the individual pieces, but the propensity of the material to spread out within a bag. It is important, then, the compression should be done in a manner which ensures that the material is spread out to the most complete extent within the bag and that, after permitting resilient expansion, will enable the material to support stacking the packages to the desired height without significant further compression.

After compression, the array 10 is permitted to resiliently expand to height B of the sleeve 14 or other vertical support means, and a tightlystretched film 18 of synthetic polymeric material is applied over the top, the bottom, at least two complete sides and the four vertical corners. The film can be made of any material which is capable of being stretched and/or shrunk into close conformity with the compressed, vertically-supported array 10. Among the suitable materials are polyethylene, polypropylene, polyethylene terephathalate, polyvinylchloride, polyvinylidene chloride, ethylenevinylacetate, polyester, polystyrene, and various of the known blends, copolymers and laminates employing these materials. Preferably, the film will comprise polyethylene and will be of a thickness suitable to maintain a moderate tension on the package as well as protect the surfaces of the bags from abrasions or impacts normally encountered in shipment and storage. In the exemplary case of polyethylene, film thickness of from about $1\frac{1}{2}$ to 6 mils are effective, with thickness of about 3 mils being preferred.

One method for applying the film to the array 10 is shown in FIG. 2. Therein, two sheets of film 18 shown joined along a seam 20. The film is cut and sealed at the opposite side from seam 20 by means of reciprocable blades 22 and 22[1] of the type known to the art which simultaneously seal and cut the film. The seal will form a seam on the side of the container opposite from seam 20 and on the severed ends of film 18 for forming the next successive package.

Where a stretchable film is employed, the film is preferably stretched over the compressed array 10 prior to sealing. The film will preferably be stretched from 10 to 50%, and preferably from 10 to 25%, of its original length in the case of polyethylene. Where a shrinkable film is employed, it is wrapped about the compressed array 10 in this same manner, but is not stretched to the same degree. Stretching the shrinkable film is in fact not necessary because it is prestretched to enable shrinkage upon heating. Heating is accomplished in any suitable manner such as by passing the package through a shrink tunnel heated sufficiently to cause the film to tightly adhere to the package.

The edges 24 and 24[1] of the film can be sealed, if desired to fully enclose and protect the contents of the package. However, this is not required. Where a shrinkable film is employed, these edges will shrink against the side of the package leaving an opening, shown as 26 in FIG. 3. Where a stretchable film is employed, it is preferred to locally heat the edges 24 and 24[1] so that these edges will adhere to the sides of the package and not cause problems in stacking and handling. FIG. 3 shows a completed package 28 of the type employing a sleeve 14, and FIG. 4 shows a completed package 30 employing angleboards 16 as the vertical support means.

Packages of either of the types shown in FIG. 3 or FIG. 4 are adapted to be stacked in layers into a unitized load 32 shown in FIG. 5. Thereafter, the unitized load is overwrapped with a tightly stretched film of synthetic polymeric material. The film can be made of any material which is capable of being stretched and/or shrunk to close conformity with the unitized load. Among the suitable materials are those previously discussed as film 18. The overwrap is performed by conventional means known to one skilled in the art. The overwrap will function to hold the packages, FIG. 3 or FIG. 4, in position to comprise the unitized load 32 shown in FIG. 5 facilitating shipping and storage. As shown in FIG. 5, six layers of packages 28 are arranged on a solid fiber slip sheet 34 to form a unitized load. The number of layers will depend on a number of factors such as the size of the individual packages and the overall pallet height restrictions. It is preferred, however, to arrange the packages in an interlocking pattern with a minimum of void space. This type of pattern provides the greatest structural integrity of the unitized load and occupies the minimum amount of space.

The following specific example is meant to illustrate one preferred embodiment of the invention and not to be limiting in any regard.

EXAMPLE

This example describes the preparation of a number of packages of the type shown in FIG. 3. These packages were tested individually and in unitized loads of the type shown in FIG. 5.

To prepare the package, an array of four, 10 pound bags of pet food of the type described in said U.S. Pat. No. 4,190,679 were placed within a 275 pound test corrugated fiberboard sleeve. The pet food comprised a mixture of hard, crunchy pieces and soft, resilient pieces essentially as described in Example I of that application. The fiberboard sleeve had external dimensions of 23 inches long, 15½ inches wide, and 6¼ inches high. The array of bags had a height prior to compression of about 8 inches. The sleeve containing the array of bags was placed between one stationary platen and one movable platen which were brought to a separation of 5.9 inches over an interval of 5 seconds at a pressure of 8.5 pounds per square inch. The pressure was released and the array was permitted to resiliently expand to the height of the corrugated fiberboard sleeve. The array and the sleeve were then wrapped with a 3 mil thick polyethylene stretch film, available from St. Regis Paper Company, with an Oliver-Pester Stretch Bander machine which operates in the manner described above with regard to FIG. 2. The edges of the film were then shrunk tightly around the end panels of the sleeve by means of a hot air gun available from Master Appliance Corporation to form a package essentially as shown in FIG. 3.

A package prepared in this manner was tested for impact resistance using an L.A.B. Corporation, Model 400CF Conbur Tester having a dolly travel before impact of 108 inches. Impact was tested on all four sides by positioning the package on the dolly with the panel which was to receive the impact flush against the backstop and parallel to the leading edge of the dolly. The dolly was then drawn back to the release point (108 inches) and released. After four impacts, one to each side, the package and its contents were free from damage, and the package still maintained adequate protection for the contents.

A like package was tested for vibration resistance in a Gaynes, Model 400V, Vibration Tester. Here, the package was placed on the table of the vibration tester and vibrated at 270 RPM for 53 minutes for a total of 14,200 vibratory impacts. Upon inspection, the package and its contents were free from damage and the package still maintained adequate protection for the contents.

In another test, a number of like packages were unitized and overwrapped and subjected to a static compression test using an L.A.B. Corporation, Model 6630 Compression Tester. Here, three tiers of test packages were assembled and placed on a pallet. A static load of 4,250 pounds was placed on the packages and maintained there for 12 days. Upon inspection at the end of the test, the packages were still supporting the static load and maintaining adequate protection for their contents. This test indicates that stacks of three or four similar unitized loads can be stored for reasonable periods without package or product damage.

Another package prepared in the manner described above was subjected to a (drop test) employing a Gaynes Engineering Company Drop Tester, Model No. 1-DTA. The package was subjected to the following ten types of drops from a height of 24 inches and then inspected for package and product damage.

Drops:
(1) Corner,
(2) Shortest edge radiating from that corner,
(3) Next longest edge radiating from that corner,
(4) Longest edge radiating from that corner,
(5) Flat on one of the smallest faces,
(6) Flat on the opposite small face,
(7) Flat on one of the medium faces,
(8) Flat on the opposite medium face,
(9) Flat on one of the largest faces,
(10) Flat on the opposite large face.

The first drop on the corner resulted in crushing of the corrugated fiberboard sleeve for approximately 1 inch radiating from the corner. The product remained free from damage and the package maintained adequate protection for the contents. None of the subsequent drops resulted in any damage to the product or the package.

The above description is for the purpose of teaching the person skilled in the art of how to practice the present invention. This description is not intended to detail all of the obvious modifications and variations of the invention which will become apparent upon reading. However, applicants do intend to include all such obvious modifications and variations within the scope of their invention which is defined by the following claims.

What is claimed is:

1. A stackable package for shipping and storing bags containing dense, compressible, and resilient material, comprising: an essentially rectangular compressed array of bags, the array having a top, a bottom and four sides forming four vertical corners, wherein the bags each contain dense, compressible, and resilient material which is compressed so that said material is capable of supporting similar packages; rigid vertical support means substantially equal in height to the height of the compressed array, positioned at least at the vertical corners of the array; and a film of a synthetic polymeric material tightly-stretched or heat shrunk over the top, the bottom, at least two complete sides and the four vertical corners.

2. A stackable package as defined in claim 1 wherein the rigid vertical support means comprises angleboards which are positioned at the vertical corners.

3. A stackable package as defined in claim 1 wherein the rigid vertical support means comprises a sleeve which surrounds all four sides of the array.

4. A stackable package as defined in claim 1 wherein the polymeric film comprises polyethylene.

5. A stackable package as defined in claim 1 wherein the rigid vertical support means comprises corrugated or laminated fiberboard.

6. A stackable package as defined in claim 5 wherein the rigid vertical support means comprises a corrugated or laminated fiberboard sleeve which surrounds all four sides of the array.

7. A method for preparing a stackable package for shipping and storing dense, compressible, and resilient material comprising:

preparing an essentially rectangular array of bags, the array having a top, bottom, and four sides forming vertical corners, wherein the bags each contain dense, compressible, and resilient material;

positioning vertical support means, having a height less than the height of the array in the uncompressed state, at least at the vertical corners of the array;

vertically compressing the array as a unit to a height less than the height of the vertical support means, whereby said material is compressed;

permitting the array to resiliently expand to a height substantially equal to the height of the vertical support means, whereby said material expands so that it is capable of supporting similar packages;

applying a tightly-stretched or heat shrinkable film of synthetic polymeric material over the top, the bottom, at least two complete sides and four vertical corners.

8. A method according to claim 7 wherein the rigid vertical support means comprises corrugated or aminated fiberboard angleboards which are positioned at the vertical corners.

9. A method according to claim 7 wherein the rigid vertical support means comprises a corrugated or laminated fiberboard sleeve which surrounds all four sides of the array.

10. A method according to claim 7 wherein the film is applied to the array by pulling it tightly over the array and heat sealing it to form a tube tightly stretched over the array.

11. A method according to claim 7 wherein the film is applied to the array and is heated to shrink it into tight adherence with the array.

12. A method according to claim 7 wherein the array is compressed between a pair of movable platens by moving both platens toward each other.

13. A method according to claim 7 wherein the array is compressed between a movable platen and a stationary platen by varying the distant between platens by the movable platen.

14. A method according to claim 7 wherein loose ends of film are shrunk into conformity with the array by heating.

15. A method according to claim 7 wherein the array is compressed prior to positioning the vertical support means at least at the vertical corners of the array.

16. A method according to claim 7 wherein the array is compressed subsequent to positioning the vertical support means at least at the vertical corners of the array.

* * * * *